United States Patent [19]

Nakamura et al.

[11] Patent Number: 5,063,752

[45] Date of Patent: Nov. 12, 1991

[54] AIR CONDITIONING APPARATUS

[75] Inventors: Takashi Nakamura; Hidekazu Tani; Tomohiko Kasai, all of Wakayama, Japan

[73] Assignee: Mitsubishi Denki Kabushiki Kaisha, Tokyo, Japan

[21] Appl. No.: 593,887

[22] Filed: Oct. 5, 1990

[30] Foreign Application Priority Data

Oct. 6, 1989 [JP] Japan ..... 1-262358

[51] Int. Cl.[5] ..... F25B 41/04

[52] U.S. Cl. ..... 62/225; 62/160; 62/324.6

[58] Field of Search ..... 62/160, 324.6, 324.1, 62/225

[56] References Cited

U.S. PATENT DOCUMENTS 4,862,705 9/1989 Nakamura et al. ..... 62/324.1

4,878,357 11/1989 Sekigami et al. ..... 62/324.6 X

FOREIGN PATENT DOCUMENTS 0057346 9/1979 Japan ..... 62/324.6

62-56429 11/1987 Japan .

*Primary Examiner*—William E. Wayner

*Attorney, Agent, or Firm*—Oblon, Spivak, McClelland, Maier & Neustadt

[57] ABSTRACT

An air conditioning apparatus comprises a single heat source device including a compressor, a reversing valve, an outdoor heat exchanger and an accumulator; a plurality of indoor units including indoor heat exchangers and first flow controllers; a first main pipe and a second main pipe for connecting between the heat source device and the indoor units, the first main pipe having a greater diameter than the second main pipe, a first branch joint which can selectively connect one end of the indoor heat exchanger of each indoor unit to either one of the first main pipe and the second main pipe; a second branch joint which is connected to the other end of the indoor heat exchanger of each indoor unit through the first flow controllers, and which is also connected to the second main pipe through a second flow controller; the first branch joint and the second branch joint being connected together through the second flow controller; a junction device which includes the first branch joint, the second flow controller and the second branch joint, and which is interposed between the heat source device and the indoor units; and a valve which is provided between the first main pipe and the second main pipe in the heat source device, and which can selectively switch the side of the first main pipe to lower pressure and the side of the second main pipe to higher pressure.

10 Claims, 5 Drawing Sheets

AIR CONDITIONING APPARATUS

The present invention relates to a multi-room heat pump type of air conditioning apparatus wherein a single heat source device is connected to a plurality of indoor units. More particularly, the present invention relates to an air conditioning apparatus wherein room cooling and room heating can be selectively carried out for each indoor unit, or wherein room cooling can be carried out in one or some indoor units, and simultaneously room heating can be carried out in the other indoor unit(s).

There has been known a heat pump type air conditioning apparatus wherein a single heat source device is connected to a plurality of indoor units through two pipes, i.e., a gas pipe and a liquid pipe, and room cooling and room heating can be selectively performed. Such a heat pump type of air conditioning apparatus is constructed to carry out the same operation mode in all indoor units, i.e., to carry out either room heating or room cooling in all indoor units at the same time.

Since the conventional multi-room heat pump type of air conditioning apparatus has been constructed as stated earlier, all indoor units can carry out either one of room heating and room cooling at the same time, which creates problems wherein a room required for cooling is subjected to room heating, and wherein a room required for heating is subjected to room cooling.

In particular, when the conventional air conditioning apparatus is installed in a large-scale building, the problems as stated just above are serious because interior zones and perimeter zones, or ordinary office rooms and office-automated rooms such as computer rooms are totally different in terms of air conditioning load.

It is an object of the present invention to resolve these problems, and provide a multi-room heat pump type air conditioning apparatus wherein a single heat source device is connected to a plurality of indoor units, and the respective indoor units can selectively carry out either room cooling or room heating to perform room cooling in one or some of the indoor units and room heating in the other indoor unit(s) at the same time, whereby even if interior zones and perimeter zones, or ordinally office rooms and office-automated rooms such as computer rooms are totally different in terms of air conditioning load in the case of installment of the apparatus in a large-scale building, the apparatus can cope with the requirements of room cooling and room heating the spaces with the respective indoor units installed in them.

The foregoing and other objects of the present invention have been attained by providing an air conditioning apparatus comprising a single heat source device including a compressor, a reversing valve, an outdoor heat exchanger and an accumulator; a plurality of indoor units including indoor heat exchangers and first flow controllers; a first main pipe and a second main pipe for connecting between the heat source device and the indoor units, the first main pipe having a greater diameter than the second main pipe; a first branch joint which can selectively connect one end of the indoor heat exchanger of each indoor unit to either one of the first main pipe and the second main pipe; a second branch joint which is connected to the other end of the indoor heat exchanger of each indoor unit through the first flow controllers, and which is also connected to the second main pipe through a second flow controller; the first branch joint and the second branch joint being connected together through the second flow controller; a junction device which includes the first branch joint, the second flow controller and the second branch joint, and which is interposed between the heat source device and the indoor units; and a switching valve arrangement which is provided between the first main pipe and the second main pipe in the heat source device, and which can selectively switch the side of the first main pipe to lower pressure and the side of the second main pipe to higher pressure.

In accordance with the present invention, the one which has a greater diameter between the main pipes for extending to connect between the heat source device and the junction device can be always utilized at the side of lower pressure, thereby improving capability. In particular, in the case wherein room heating is principally performed under room cooling and room heating concurrent operation, the main pipe having a greater diameter can be utilized at the side of lower pressure to decrease the difference between the evaporation pressure of the outdoor heat exchanger and that in the indoor heat exchanger(s) of room cooling indoor unit(s). As a result, the evaporation pressure in the indoor heat exchanger(s) can be lowered to prevent cooling capability from being lacking. In addition, the evaporation pressure in the outdoor heat exchanger can be raised to prevent the heat exchanger from being frozen and capability from lowering.

Figure 1:
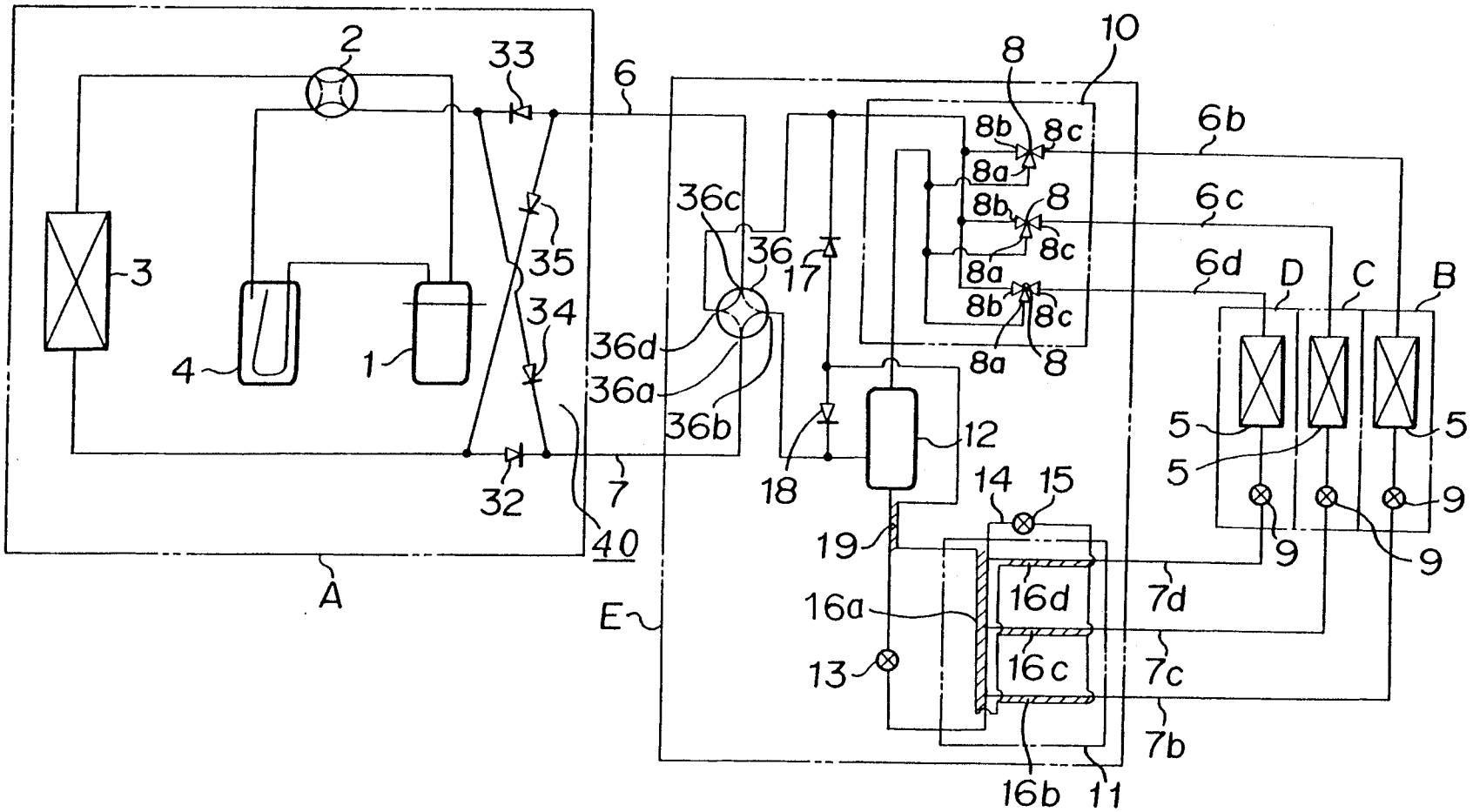
FIG. 1 is a schematic diagram of the entire structure of a first embodiment of the air conditioning apparatus according to the present invention, which is depicted on the basis of the refrigerant system of the apparatus.
Figure 4:
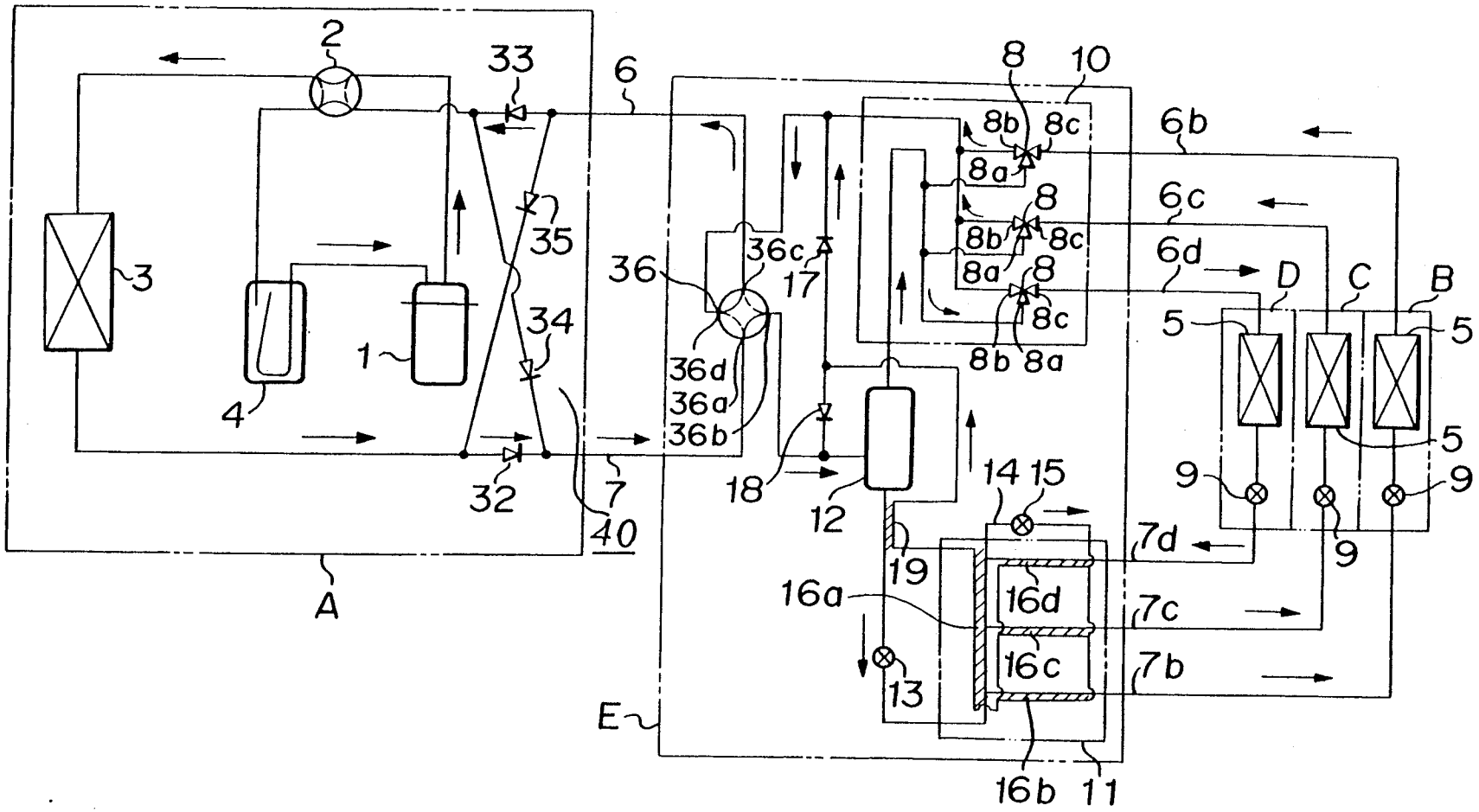
Figure 5:
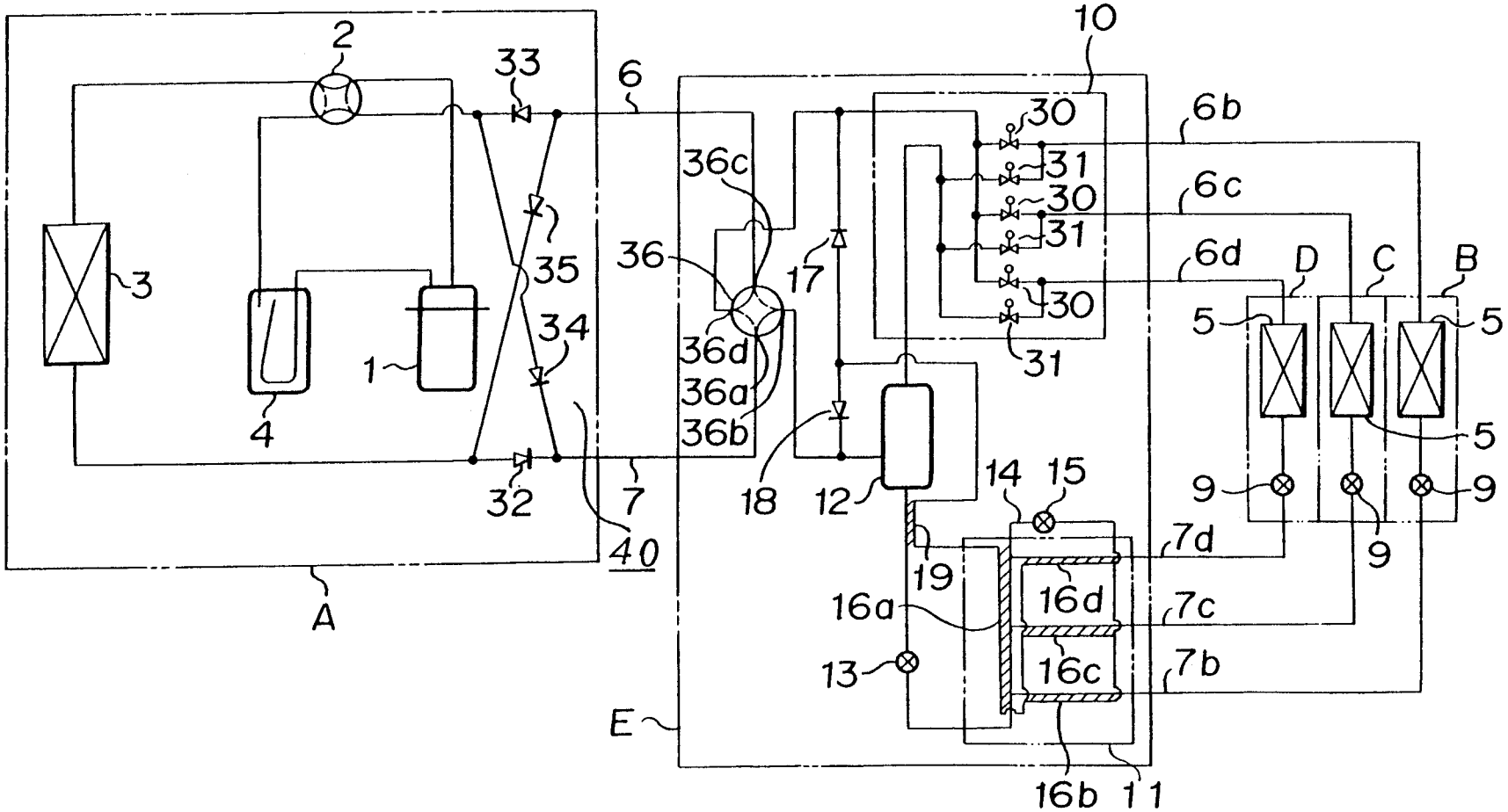

FIG. 4 is a schematic diagram showing the operation state of the first embodiment of the FIG. 1 wherein room cooling is principally performed under room cooling and room heating concurrent operation (cooling load is greater than heating load); and FIG. 5 is a schematic diagram showing the entire structure of another embodiment which is depicted on the basis of the refrigerant system of the apparatus.

Now, the present invention will be described in detail with reference to preferred embodiments illustrated in the accompanying drawings.

Explanation of the preferred embodiments will be made for the case wherein a single heat source device is connected to three indoor units. The following explanation is also applicable to the case wherein a single source device is connected to 2 or more indoor units.

In FIG. 1, reference numeral A designates the heat source device. Reference numerals B, C and D designate the indoor units which are connected in parallel as described later on, and which have the same structure.

Reference numeral E designates a junction device which includes a first branch joint 10, a second flow controller 13, a second branch joint 11, a gas-liquid separator 12, heat exchanging portions 19, **16*a*, 16*b*, 16*c* and 16*d*, a second reversing valve 36**.

Reference numeral 1 designates a compressor. Reference numeral 2 designates a first four port reversing valve which can switch the flow direction of a refrigerant in the heat source device. Reference numeral 3 designates an outdoor heat exchanger which is installed at the side of the heat source device. Reference numeral 4 designates an accumulator which is connected to the compressor 1, the reversing valve 2 and the outdoor heat exchanger 3 to constitute the heat source device A. Reference numeral 5 designates three indoor heat exchangers. Reference numeral 6 designates a first main pipe which has a large diameter and which connects the first four port reversing valve 2 of the heat source device A to the junction device E. Reference numerals 6*b*, 6*c* and 6*d* designate first branch pipes which connect the junction device E to the indoor heat exchangers 5 of the respective indoor units B, C and D, and which correspond to the first main pipe 6. Reference numeral 7 designates a second main pipe which has a smaller diameter than the first main pipe, and which connects the junction device E to the outdoor heat exchanger 3 of the heat source device A. Reference numerals 7*b*, 7*c* and 7*d* designate second branch pipes which connect the junction device E to the indoor heat exchangers 5 of the respective indoor units B, C and D, and which correspond to the second main pipe 7. Reference numeral 8 designates three port switching valves which can selectively connect the first branch pipes 6*b*, 6*c* and 6*d* to either the first main pipe 6 or the second main pipe 7. Reference numeral 9 designates first flow controllers which are connected to the respective indoor heat exchangers 5 in close proximity to the same, which are controlled based on superheat amounts on room cooling and subcool amounts on room heating at the outlet sides of the respective indoor heat exchangers, and which are connected to the second branch pipes 7*b*, 7*c* and 7*d*, respectively. Reference numeral 10 designates the first branch joint which includes the three port switching valves 8 which can selectively the first branch pipes 6*b*, 6*c* and 6*d* to either the first main pipe 6 or the second main pipe 7. Reference numeral 11 designates the second branch joint which includes the second branch pipes 7*b*, 7*c* and 7*d*, and the second main pipe 7. Reference numeral 12 designates the gas-liquid separator which is arranged in the second main pipe 7, and which has a gas layer zone connected to first ports 8*a* of the respective switching valves 8 and a liquid layer zone connected to the second branch joint 11.

Reference numeral 13 designates the second flow controller which is connected between the gas-liquid separator 12 and the second branch joint 11, and which can be selectively opened and closed. Reference numeral 14 designates a bypass pipe which connects the second branch joint 11 to the first main pipe 6 and the second main pipe 7. Reference numeral 15 designates a third flow controller which is arranged in the bypass pipe 14. Reference numerals 16*b*, 16*c* and 16*d* designate the third heat exchanging portions which are arranged in the bypass pipe 14 downstream of the third flow controller 15 and which carry out heat exchanging with the respective second branch pipes 7*b*, 7*c* and 7*d* in the second branch joint 11. Reference numeral 16*a* designates the second heat exchanging portion which is arranged in the bypass pipe 14 downstream of the third flow controller 15, and which carries out heat exchanging with the portion where the second branch pipes 7*b*, 7*c* and 7*d* join in the second branch joint. Reference numeral 19 designates the first heat exchanging portion which is arranged in the bypass pipe 14 downstream of the third flow controller and the second heat exchanging portion 16*a*, and which carries out heat exchanging with the pipe which connects between the gas-liquid separator 12 and the second flow controller 13. Reference numeral 17 designates a first check valve which is arranged between the first heat exchanging portion 19 of the bypass pipe 14 and the first main pipe 6. Reference numeral 18 designates a second check valve which is arranged between the first heat exchanging portion 19 of the bypass pipe 14 and the second main pipe 7, and which is parallel to the first check valve 17. The first check valve 17 and the second check valve 18 allows the refrigerant only to flow from the first heat exchanging portion 19 to the first and the second main pipes 6 and 7. Reference numeral 32 designates a third check valve which is arranged between the outdoor heat exchanger 3 and the second main pipe 7, and which allows the refrigerant only to flow from the outdoor heat exchanger 3 to the second main pipe 7. Reference numeral 33 designates a fourth check valve which is arranged between the four port reversing valve 2 of the heat source device A and the first main pipe 6, and which allows the refrigerant only to flow from the first main pipe 6 to the reversing valve 2. Reference numeral 34 designates a fifth check valve which is arranged between the reversing valve 2 and the second main pipe 7, and which allows the refrigerant to flow from the reversing valve 2 to the second main pipe 7. Reference numeral 35 designates a sixth check valve which is arranged between the outdoor heat exchanger 3 and the first main pipe 6, and which allows the refrigerant only to flow from the first main pipe 6 to the outdoor heat exchanger 3. These check valves 32–35 constitute a switching valve arrangement 40. Reference numeral 36 designates the second reversing valve 36 which has four ports 36*a*, 36*b*, 36*c* and 36*d*, and which is arranged in the junction device E between the first main pipe 6 and the second main pipe 7 which connect between the heat source device A and the junction device E. The first port 36*a* is connected to the second main pipe 7, the second port 36*b* is connected to the gas-liquid separator 12, the third port 36*c* is connected to the first main pipe 6, and the fourth port 36*d* is connected to the second ports 8*b* of the three port switching valves 8.

The operation of the first embodiment as constructed above will be explained.

Figure 2:
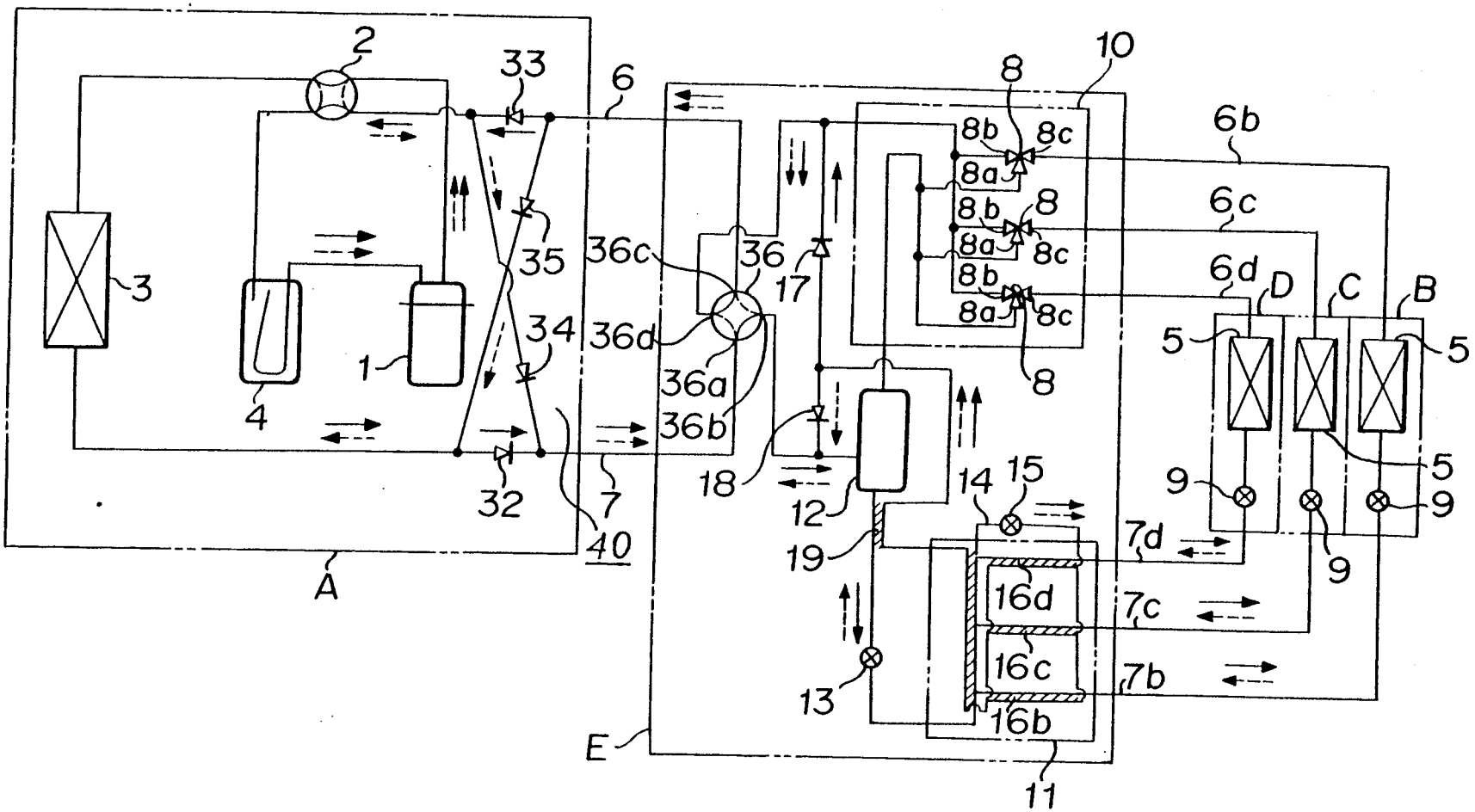
FIG. 2 is a schematic diagram showing the operation states of the first embodiment of FIG. 1 wherein solo operation on room cooling and solo operation on room heating are performed.

Firstly, the case wherein only room cooling is performed will be explained with reference to FIG. 2.

In this case, the flow of the refrigerant is indicated by arrows of solid line. The refrigerant gas which has discharged from the compressor 1 and been a gas having high temperature under high pressure passes through the four port reversing valve 2, and is heat exchanged and condensed in the outdoor heat exchanger 3 to be liquefied. Then, the liquefied refrigerant passes through the third check valve 32, the second main pipe 7, and the first port 36*a* and the second port 36*b* of the reversing valve 36 in the junction device E. In addition, the refrigerant passes through the gas-liquid separator 12 and the second flow controller 13 in that order. The refrigerant further passes through the second branch joint 11 and the second branch pipes 7*b*, 7*c* and 7*d*, and enters the indoor units B, C and D. The refrigerant which has entered the indoor units B, C and D is depressurized to low pressure by the first flow controllers 9 which are controlled based on the superheat amount at the outlet of each indoor heat exchanger 5. In the indoor heat exchangers 5, the refrigerant thus depressurized carries out heat exchanging with the air in the rooms having the indoor heat exchangers to be evaporated and gasified, thereby cooling the rooms. The refrigerant so gasified passes through the first branch pipes 6*b*, 6*c* and 6*d*, the three port switching valves 8, the first branch joint 10, and the fourth port 36*d* and the third port 36*c* of the reversing valve 36 in the junction device E. Then the refrigerant is inspired into the compressor through the first main pipe 6, the fourth check valve 33, the first four port reversing valve 2 in the heat source device, and the accumulator 4. In this way, a circulation cycle is formed to carry out room cooling. At this mode, the three port switching valves 8 have the first ports 8*a* closed, and the second ports 8*b* and the third ports 8*c* opened. The four port reversing valve 36 in the junction device E allows the refrigerant to flow from the first port 36*a* to the second port 36*b*, and to flow from the fourth port 36*d* to the third port 36*c*. At the time, the first main pipe 6 is at low pressure in it, and the second main pipe 7 is at high pressure in it, which necessarily make the third check valve 32 and the fourth check valve 33 to conduct.

In addition, in this mode, the refrigerant which has passed through the second flow controller 13 partly enters the bypass pipe 14 where the entered part of the refrigerant is depressurized to low pressure by the third flow controller 15. The refrigerant thus depressurized carries out heat exchanging with the second branch pipes 7*b*, 7*c* and 7*d* at the third heat exchanging portions 16*b* 16*c*and 16*d*, with the jointed portion of the second branch pipes 7*b*, 7*c* and 7*d* at the second heat exchanging portion 16*b* in the second branch joint 11, and at the first heat exchanging portion 19 with the refrigerant which enters the second flow controller 13. The refrigerant is evaporated due to such heat exchanging, and passes through the first check valve 17, the four port reversing valve 36, the first main pipe 6, and the fourth check valve 33. Then the refrigerant is inspired into the compressor 1 through the first four port reversing valve 2 and the accumulator 4.

At this time, the first main pipe 6 is at low pressure in it, and the second main pipe 7 is at high pressure in it, which necessarily make the first check valve 17 conduct. On the other hand, the refrigerant, which has heat exchanged at the first heat exchanging portion 19, the second heat exchanging portion 16*a*, and the third heat exchanging portions 16*b*, 16*c*and 16*d*, and has been cooled so as to get sufficient subcool, enters the indoor units B, C and D which are expected to carry out room cooling.

Secondly, the case wherein only room heating is performed will be described with reference FIG. 2. In this case, the flow of the refrigerant is indicated by arrows of dotted line.

The refrigerant which has been discharged from the compressor 1 and been a gas having high temperature under high pressure passes through the four port reversing valve 2, the fifth check valve 34, the second main pipe 7, and the first port 36*a* and the fourth port 36*d* of the reversing valve 36 in the junction device E. Then the refrigerant passes through the first branch joint 10, the three port switching valves 8, and the first branch pipes 6*b*, 6*c* and 6*d* in that order. After that, the refrigerant enters the respective indoor units B, C and D where the refrigerant carries out heat exchanging with the air in the rooms having the indoor units. The refrigerant is condensed to be liquefied due to such heat exchanging, thereby heating the rooms. The refrigerant thus liquefied passes through the first flow controllers 9 which are controlled based on subcool amounts at the outlets of the respective indoor heat exchangers 5. Then the refrigerant enters the second branch joint 11 through the second branch pipes 7*b*, 7*c* and 7*d*, and joins. Then the joined refrigerant passes through the second flow controller 13. The refrigerant is depressurized by either the first flow controllers 9 or the second flow controller 13 to take a two phase state having low pressure. The refrigerant thus depressurized passes through the gas-liquid separator 12, the second port 36*b* and the third port 36*c* of the reversing valve 36, and the first main pipe 6. Then the refrigerant enters the outdoor heat exchanger 3 through the sixth check valve 35 of the heat source device A, and carries out heat exchanging to be evaporated and gasified. The refrigerant thus gasified is inspired into the compressor 1 through the first four port reversing valve 2 of the heat source device, and the accumulator 4. In this way, a circulation cycle is formed to carry out room heating. In this mode, the opening and closing states of the ports of the switching valves 8 are the same as those of the switching valves in the case wherein only room cooling is carried out.

In this mode, the four port reversing valve 36 allows the refrigerant to flow from the first port 36*a* to the fourth port 36*d*, and to flow from the second port 36*d* to the third port 36*c*. The first main pipe 6 is at low pressure in it, and the second main pipe 7 is at high pressure in it, which necessarily causes the fifth check valve 34 and the sixth check valve 35 to conduct.

Figure 3:
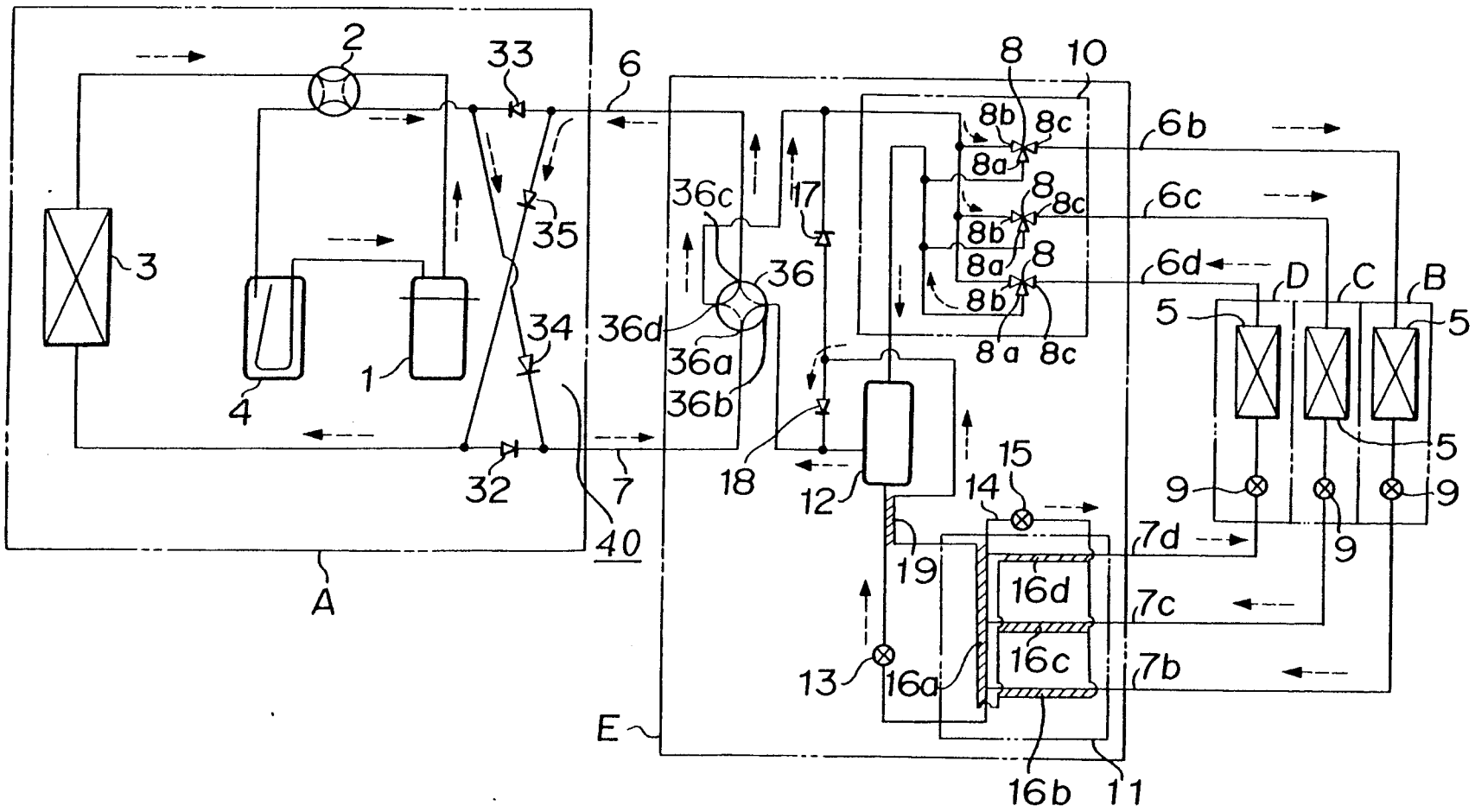
FIG. 3 is a schematic diagram showing the operation state of the first embodiment of FIG. 1 wherein room heating is principally performed under room cooling and room heating concurrent operation (heating load is greater than cooling load)

Thirdly the case wherein room heating is principally performed in room cooling and room heating concurrent operation will be explained with reference to FIG. 3. In FIG. 3, arrows of dotted line indicate the flow of the refrigerant.

The refrigerant which has been discharged from the compressor 1, and been a gas having high temperature under high pressure passes through the four port reversing valve 2, and then reaches the junction device E through the fifth check valve 34 and the second main pipe 7. The refrigerant flows through the first port 36*a* and the fourth port 36*d* of the reversing valve 36 of the junction device E. In addition, the refrigerant passes through the first branch joined 10, the three port switching valves 8, and the first branch pipes 6*b* and 6*c* in that order, and enters the indoor units B and C which are expected to carry out room heating. In the indoor heat exchangers 5 of the respective indoor units B and C, the refrigerant carries out heat exchange with the air in the rooms having the indoor units B and C installed in them, to be condensed and liquefied, thereby heating the rooms. The refrigerant thus condensed and liquefied passes through the first flow controllers 9 of the indoor units B and C, the first controllers 9 of the indoor units B and C being almost fully opened under the control based on the subcool amounts at the outlets of the corresponding indoor heat exchangers 5. The refrigerant is slightly depressurized by these first flow controllers 9, and flows into the second branch joint 11. After that, the refrigerant partly passes through the second branch pipe 7*d* of the indoor unit D which is expected to carry out room cooling, and enters the indoor unit D. The refrigerant flows into the first flow controller 9 of the indoor unit D, the first flow controller 9 being controlled based on the superheat amount at the outlet of the corresponding indoor heat exchanger 5. After the refrigerant is depressurized by this first flow controller 9, it enters the indoor heat exchanger 5, and carries out heat exchange to be evaporated and gasified, thereby cooling the room with this indoor heat exchanger 5 in it. Then the refrigerant enters the gas-liquid separator 12 through the three port switching valve 8 which is connected to the indoor unit D.

On the other hand, the remaining refrigerant passes through the second flow controller 13 which is selectively opened and closed depending on the difference between the pressure in the second main pipe 7 and that in the second branch joint 11. Then the refrigerant enters the gas-liquid separator 12, and joins there with the refrigerant which has passed the indoor unit D which is expected to carry out room cooling. After that, the refrigerant thus joined flows from the second port 36*b* to the third port 36*c* of the reversing valve 36 in the junction device E, passes through the first main pipe 6 and the sixth check valve 5 of the heat source device A, and enters the outdoor exchanger 3 where the refrigerant carries out heat exchange to be evaporated and gasified. The refrigerant thus gasified is inspired into the compressor 1 through the heat source device reversing valve 2 and the accumulator 4. In this way, a circulation cycle is formed to carry out the room cooling and room heating concurrent operation wherein room heating is principally performed.

At this time, the difference between the evaporation pressure in the indoor heat exchanger 5 of the room cooling indoor unit D and that of the outdoor heat exchanger 3 lessens because of switching to the first main pipe 6 having a greater diameter. The three port switching valves 8 which are connected to the room heating indoor units B and C have the first ports 8*a* closed, and the second ports 8*b* and the third ports 8*c* opened. The three port switching valve 8 which is connected to the room cooling indoor unit D has the second port 8*b* closed, and the first port 8*a* and the third port 8*c* opened.

The four port reversing valve 36 in the junction device E allows the refrigerant to flow from the first port 36*a* to the fourth port 36*d*, and to flow from the second port 36*b* to the third port 36*c*. In this mode, the first main pipe 6 is at low pressure in it, and the second main pipe 7 is at high pressure in it, which necessarily causes the fifth check valve 34 and the sixth check valve 35 to conduct. At this circulation cycle, the liquefied refrigerant partly goes into the bypass pipe 14 from the joint portion of the second branch joint 11 where the second branch pipes 7*b*, 7*c* and 7*d* join together. The refrigerant which has gone into the bypass pipe 14 is depressurized to low pressure by the third flow controller 15. The refrigerant thus depressurized carries out heat exchange with the refrigerant in the second branch pipes 7*b*, 7*c* and 7*d* at the third heat exchanging portions 16*b*, 16*c*and 16*d*, with the refrigerant in the joint portion of the second branch pipes 7*b*, 7*c* and 7*d* in the second branch joint 11 at the second heat exchanging portion 16*a*, and at the first heat exchanging portion 19 with the refrigerant which comes from the second flow controller 13. The refrigerant is evaporated by such heat exchange, passes through the second check valve 18, and enters the first main pipe 6 through the four port reversing valve 36 of the junction device B. After that, the refrigerant flows into the sixth check valve 35 and then into the outdoor heat exchanger 3 where it performs heat exchange to be evaporated and gasified. The refrigerant thus gasified is inspired into the compressor 1 through the first four port reversing valve 2 and the accumulator 4.

In this mode, the first main pipe 6 is at low pressure in it, and the second main pipe 7 is at high pressure in it, which necessarily causes the second check valve 18 to conduct. On the other hand, the refrigerant in the second branch joint 11 which has carried out heat exchange and cooled at the second heat exchanging portion 16*a*, and the third heat exchanging portions 16*b*, 16*c*and 16*d* to obtain sufficient subcool flows into the indoor unit D which is expected to cool the room with the indoor unit D installed in it.

Fourthly, the case wherein room cooling is principally performed in room cooling and room heating concurrent operation will be described with reference to FIG. 4.

In FIG. 4, arrows of solid lines indicate the flow of the refrigerant. The refrigerant which has been discharged from the compressor 1 and been a gas having high temperature under high pressure carries out heat exchange at an arbitrary amount in the outdoor heat exchanger 3 to take a two phase state having high temperature under high pressure. Then the refrigerant passes through the third check valve 32, the second main pipe 7, and the first port 36*a* and the second port 36*b* of the reversing valve 36 in the junction device E, and is forwarded to the gas-liquid separator 12. The refrigerant is separated into a gaseous refrigerant and a liquid refrigerant there, and the gaseous refrigerant thus separated flows through the first branch joint 10, and the three port switching valve 8 and the first branch pipe 6*d* which are connected to the indoor unit D, in that order, the indoor unit D being expected to heat the room with the indoor unit D installed in it. The refrigerant flows into the indoor unit D, and carries out heat exchange with the air in the room with the indoor heat exchanger 5 of the heating indoor unit D installed in it to be condensed and liquefied, thereby heating the room. In addition, the refrigerant passes through the first flow controller 9 connected to in the room heating indoor unit D, this first flow controller 9 being almost fully opened under the control based on the subcool amount at the outlet of the indoor heat exchanger 5 of the heating indoor unit D. The refrigerant is slightly depressurized by this first flow controller 9, and flows into the second branch joint 11. On the other hand, the liquid refrigerant enters the second branch joint 11 through the second flow controller 13 which can be selectively opened and closed depending on the difference between the pressure in the second main pipe 7 and that in the second branch joint 11. Then the refrigerant joins there with the refrigerant which has passed through the heating indoor unit D. The refrigerant thus joined passes through the second branch joint 11, and then the second branch pipes 7*b*and 7*c*, respectively, and enters the respective indoor units B and C. The refrigerant which has flowed into the indoor units B and C is depressurized to low pressure by the first flow controllers 9 of the indoor units B and C, these first flow controllers 9 being controlled based on the superheat amounts at the outlets of the corresponding indoor heat exchangers 5. Then the refrigerant flows into the indoor heat exchangers 5, and carries out heat exchange with the air in the rooms having these indoor units B and C to be evaporated and gasified, thereby cooling these rooms. In addition, the refrigerant thus gasified passes through the first branch pipes 6*b* and 6*c*, the three port switching valves 8, the first branch joint 10, and the fourth port 36*d* and the third port 36*c* of the reversing valve 36 in the junction device E. Then the refrigerant is inspired into compressor 1 through the first main pipe 6, the fourth check valve 33, the first four port reversing valve 2 in the heat source device A, and the accumulator 4. In this way, a circulation cycle is formed to carry out the room cooling and room heating concurrent operation wherein room cooling is principally performed. In this mode, the three port switching valves 8 which are connected to the indoor units B, C and D have the first ports 8*a* through the third ports 8*c* opened and closed like those in the room cooling and room heating concurrent operation wherein room heating is principally performed.

In this circulation cycle, the liquid refrigerant partly enters the bypass pipe 14 from the joint portion of the second branch joint 11 where the second branch pipes 7*b*, 7*c* and 7*d* join together. The liquid refrigerant which has entered into the bypass pipe 14 is depressurized to low pressure by the third flow controller 15. The refrigerant thus depressurized carried out heat exchange with the refrigerant in the second branch pipes 7*b*, 7*c* and 7*d* at the third heat exchanging portions 16*b*, 16*c*and 16*d*, and at the second heat exchanging portion 16*a* with the refrigerant in the joint portion of the second branch pipes 7*b*, 7*c* and 7*d* in the second branch joint 11, and at the first heat exchanging portion 19 with the refrigerant which flows into the second flow controller 13. The refrigerant is evaporated by such heat exchange, and enters the first main pipe 6 through the first check valve 17 and the reversing valve 36 in the junction device E. The refrigerant which has entered the first main pipe 6 is inspired into the compressor 1 through the fourth check valve 33, the first four port reversing valve 2 in the heat source device A, and the accumulator 4.

On the other hand, the refrigerant in the second branch joint 11 which has carried out heat exchange and cooled at the first heat exchanging portion 19, the second heat exchanging portion 16*a*, and the third heat exchanging portions 16*b*, 16*c*and 16*d* to obtain sufficient subcool flows into the indoor units B and C which are expected to carry out room cooling.

Although in the first embodiment the three port switching valves 8 can be arranged to selectively connect the first branch pipes 6*b*, 6*c* and 6*d* to either the first main pipe 6 or the second main pipe 7, paird on-off valves such as solenoid valves 30 and 31 can be provided instead of the three port switching valves as shown as another embodiment in FIG. 5 to make selective switching, offering similar advantage. In addition, although in the first embodiment switching the room cooling mode and the room heating mode is made by the reversing valve 36 in the junction device E, the three port switching valves 8 in the first branch joint 10 can be utilized for such switching. That is to say, when the indoor units carry out room cooling, the three port switching valves 8 have the second ports 8*b* and the third ports 8*c* opened, and the first ports 8*a* closed to make connection with the first main pipe 6. When the indoor units carry out room heating, the three port switching valves 8 have the first ports 8*a* and the third ports 8*c* opened, and the second ports 8*b* closed to make connection with the second main pipe 7. In this way, similar effect can be obtained.

What is claimed is:

1. An air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units, the first main pipe having a greater diameter than the second main pipe;

a first branch joint which can selectively connect one end of the indoor heat exchanger of each indoor unit to either one of the first main pipe and the second main pipe;

a second branch joint which is connected to the other end of the indoor heat exchanger of each indoor unit through the first flow controllers, and which is also connected to the second main pipe through a second flow controller;

the first branch joint and the second branch joint being connected together through the second flow controller;

a junction device which includes the first branch joint, the second flow controller and the second branch joint, and which is interposed between the heat source device and the indoor units; and valve means provided between the first main pipe and the second main pipe in the heat source device, which can selectively switch the side of the first main pipe to lower pressure and the side of the second main pipe to higher pressure.

2. An air conditioning apparatus according to claim 1, wherein the value means in the heat source device comprises a combination of check valves.

3. An air conditioning apparatus according to claim 1, wherein the junction device includes a valve between the first main pipe and the second main pipe, the valve being capable of selectively connecting the first main pipe to the first branch joint, and the second main pipe to the second branch joint, and vice versa.

4. An air conditioning apparatus according to claim 3, wherein the valve in the junction device is a four port reversing valve.

5. An air conditioning apparatus according to claim 3, wherein the second main pipe has a gas-liquid separator therein, the gas-liquid separator having a gas layer zone connected to the first branch joint, and a liquid layer zone connected to the second branch joint.

6. An air conditioning apparatus according to claim 3, wherein the second branch joint, and the first and the second main pipe are connected through a bypass pipe.

7. An air conditioning apparatus according to claim 6, wherein the bypass pipe has a third flow controller therein.

8. An air conditioning apparatus according to claim 6, wherein the bypass pipe has a first heat exchanging portion which is located downstream of the third flow controller to carry out heat exchange with a pipe for connecting between the gas-liquid separator and the second flow controller.

9. An air conditioning apparatus according to claim 8, wherein the bypass pipe has therein a second heat exchanging portion which is located upstream of the first heat exchanging portion and downstream of the third flow controller, and wherein the indoor units have branch pipes connected to the second branch joint, respectively, the second heat exchanging portion carrying out heat exchange at the joint portion where the branch pipes joint together in the second branch joint.

10. An air conditioning apparatus according to claim 9, wherein the bypass pipe has therein third heat exchanging portions which are located upstream of the second heat exchanging portion and downstream of the third flow controller, the third heat exchanging portions carrying out heat exchange with the branch pipes.

* * * * *